US007150606B2

(12) United States Patent
Bonfardeci et al.

(10) Patent No.: US 7,150,606 B2
(45) Date of Patent: Dec. 19, 2006

(54) ELECTROMAGNETIC FUEL PUMP

(75) Inventors: Anthony J. Bonfardeci, New Hartford, NY (US); David J. Stabile, Horseheads, NY (US); Craig S. Weber, Erin, NY (US)

(73) Assignee: Motor Components LLC, Elmira Heights, NY (US)

( * ) Notice: Subject to any disclaimer, the term of this patent is extended or adjusted under 35 U.S.C. 154(b) by 249 days.

(21) Appl. No.: 10/695,360

(22) Filed: Oct. 28, 2003

(65) Prior Publication Data

US 2005/0089418 A1 Apr. 28, 2005

(51) Int. Cl.
*F04B 17/04* (2006.01)
*F04B 35/04* (2006.01)

(52) U.S. Cl. ..... 417/417; 310/30

(58) Field of Classification Search ..... 417/416, 417/417; 310/30

See application file for complete search history.

(56) References Cited

U.S. PATENT DOCUMENTS

| | | | | | |
|---|---|---|---|---|---|
| 1,640,742 | A | * | 8/1927 | Wallace et al. | 310/34 |
| 3,400,663 | A | * | 9/1968 | Wertheimer | 417/417 |
| 3,629,674 | A | | 12/1971 | Brown | 318/128 |
| 3,797,522 | A | | 3/1974 | Carleton | 137/528 |
| 4,047,852 | A | * | 9/1977 | O'Connor et al. | 417/415 |
| 4,101,950 | A | * | 7/1978 | Hager et al. | 361/203 |
| 4,169,696 | A | * | 10/1979 | Brown | 417/417 |
| 4,299,544 | A | | 11/1981 | Masaka | 417/417 |
| 4,306,842 | A | | 12/1981 | Masaka | 417/417 |
| 4,306,843 | A | * | 12/1981 | Arai | 417/417 |
| 4,389,169 | A | * | 6/1983 | De Dionigi | 417/417 |
| 4,464,613 | A | | 8/1984 | Brown | 318/119 |
| 4,643,653 | A | * | 2/1987 | Masaka et al. | 417/417 |
| 4,661,048 | A | * | 4/1987 | Masaka et al. | 417/360 |
| 4,725,208 | A | * | 2/1988 | Brown | 417/417 |
| 4,749,892 | A | * | 6/1988 | Mesenich | 310/19 |
| 4,775,301 | A | * | 10/1988 | Cartwright et al. | 417/417 |
| 4,778,357 | A | * | 10/1988 | Arai et al. | 417/417 |
| 4,895,495 | A | * | 1/1990 | Arai | 417/360 |
| 4,924,031 | A | * | 5/1990 | Arai | 174/52.3 |
| 4,934,907 | A | * | 6/1990 | Kroner | 417/417 |
| 5,073,095 | A | * | 12/1991 | Thomas, Sr. | 417/417 |
| 5,165,871 | A | * | 11/1992 | Iwabuchi | 417/417 |
| 5,915,930 | A | * | 6/1999 | McNaull | 417/417 |
| 6,273,689 | B1 | * | 8/2001 | Kenichi et al. | 417/417 |
| 6,960,068 | B1 | * | 11/2005 | McNaull | 417/423.1 |
| 2002/0136650 | A1 | * | 9/2002 | Sakurai et al. | 417/415 |
| 2004/0022651 | A1 | * | 2/2004 | Hashimoto et al. | 417/417 |
| 2004/0241017 | A1 | * | 12/2004 | Buzzi | 417/415 |
| 2005/0025638 | A1 | * | 2/2005 | Buffet | 417/416 |
| 2005/0063841 | A1 | * | 3/2005 | Chen et al. | 417/417 |

* cited by examiner

*Primary Examiner*—William H. Rodriguez
(74) *Attorney, Agent, or Firm*—Simpson & Simpson, PLLC

(57) ABSTRACT

An electromagnetic fuel pump, including a pump, an electronic control circuit board assembly (PCB) and electromagnetic coil operatively arranged to operate the pump, and, a housing arranged to house the pump and the PCB/coil assembly, the housing including an integral inlet port and outlet port.

19 Claims, 8 Drawing Sheets

Prior Art

ELECTROMAGNETIC FUEL PUMP

FIELD OF THE INVENTION

The present invention broadly relates to fuel pumps, and more specifically, to electromagnetic fuel pumps and, even more specifically, to an electromagnetic fuel pump having a housing with integral inlet and outlet ports.

BACKGROUND OF THE INVENTION

Electromagnetic fuel pumps are subject to demands that are not made on other types of pumps. In view of their intended use in association with motor vehicle, marine, generator, military, and agricultural applications, electromagnetic pumps must be capable of maintaining long-term, stable operational lives under extremely adverse working conditions. In addition, since millions of applications require fuel pumps, the number of electromagnetic pumps that are produced on an annual basis is high. Hence, cost considerations relating to pump manufacture dictates that a minimal number of parts be utilized. In addition, manufacturing processes must be accurate and reproducible such that identical pumps are produced. Finally, the manufacture of electromagnetic fuel pumps must be simple such that pumps can be quickly assembled using ordinarily skilled labor.

Both internal and external variables impact a pump's performance. Fuel, which in most instances comprises gasoline, or diesel, are aggressive solvents that are capable of deteriorating internal components of a pump. As a result, pump components must be protected from contact with the solvents. Various configurations of O-rings and sealing collars have been disclosed in the prior art for preventing such contact.

External factors, such as temperature, humidity, and fluid leaks, can also contribute to the problematic effects of pump instability and lead to shorter pump lifespan. Such factors can cause excitation timing circuits to behave irregularly, or they can accelerate the deterioration of the mechanical and electrical components of the pump. The incursion of salt water into pumps during the winter months in northern climates can also cause extensive damage to both the mechanical and electrical components of a pump. Such damage is usually attributed to the accelerated corrosion effects of the galvanic circuit created by salt water and dissimilar metals present within electronic circuits.

The formation of pump housings has typically been one of the most difficult stages in the construction of an electromagnetic fuel pump. Known methods have generally included the bending of U-shaped yokes, assembly of multiple stamped sheet metal pieces, or foam filling completed assemblies for environmental compatibility. Unfortunately, these types of designs have been problematic in assembly and have been particularly unreliable in use. In known pump designs, such as that shown in FIG. 1, inlet and outlet ports have conventionally been components that are separate from the pump housing with which they communicate. Inlet and outlet ports have been traditionally detachably secured to housings by means of threaded nuts and the like. Assembly of the pump inlet and outlet ports has heretofore been very labor-intensive.

Additionally, the location tolerances of moving parts of a pump have also presented challenges to the construction of electromagnetic pumps. Alignment of moving components, with respect to the inlet and outlet ports of a pump, requires highly accurate methods of assembly. Previous methods have utilized the pump housing to locate the surfaces to which the pump is built and aligned. Constraints created by the bending of U-shaped yokes and the stamping of individual metal housing pieces has limited the manufacturer's ability to coaxially align the inlet port, the outlet port, and the moving pump components. Such lack of coaxial alignment can reduce the pump efficiency and the stability of the pump performance.

Furthermore, pumps known in the art typically comprise driving circuits that include a dual winding coil, i.e., one magnetic winding and one oscillator feedback winding. The coil together, with resistors, diodes, a transistor, and a power source, comprise the oscillator circuit, which drives the pumping mechanism. The dual winding coil requirement of most current pumps presents problems related to pump manufacture. For example, in order to manufacture a pump comprising two differently gauged coil wires, the manufacturer must stock and store the two differently gauged coil wires, which can be costly in terms of materials and space requirements. In addition, one winding is of a very small and fragile gauge wire.

Known pumps have also suffered from the lack of on-board EM hardening and surge suppression circuitry.

Thus, there has been a longfelt need for an electromagnetic fuel pump with inlet and outlet ports that are integral to the pump housing and have on-board surge suppression and EM hardening.

BRIEF SUMMARY OF THE INVENTION

The present invention broadly comprises an electromagnetic fuel pump comprising a pump, an electromagnetic coil operatively arranged to operate the pump, and a housing arranged to house the pump and coil, the housing comprising an integral inlet port and outlet port. In a preferred embodiment, the fuel pump includes on-board (e.g., within the housing) electromagnetic (EM) hardening and on-board surge suppression circuitry, in addition to a single-wire coil.

A general object of the invention is to provide an electromagnetic fuel pump having inlet and outlet ports, which are integral with the pump housing, and a backwards-compatible configuration based on the same platform.

Another object of the invention is to provide an electromagnetic fuel pump having on-board EM hardening, controlled pump speed, and on-board surge suppression circuitry with the use of a single-wire coil.

These and other objects, features and advantages of the present invention will become readily apparent to those having ordinary skill in the art upon reading the following detailed description in view of the several drawing views and appended claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed embodiments.

Figure 1:
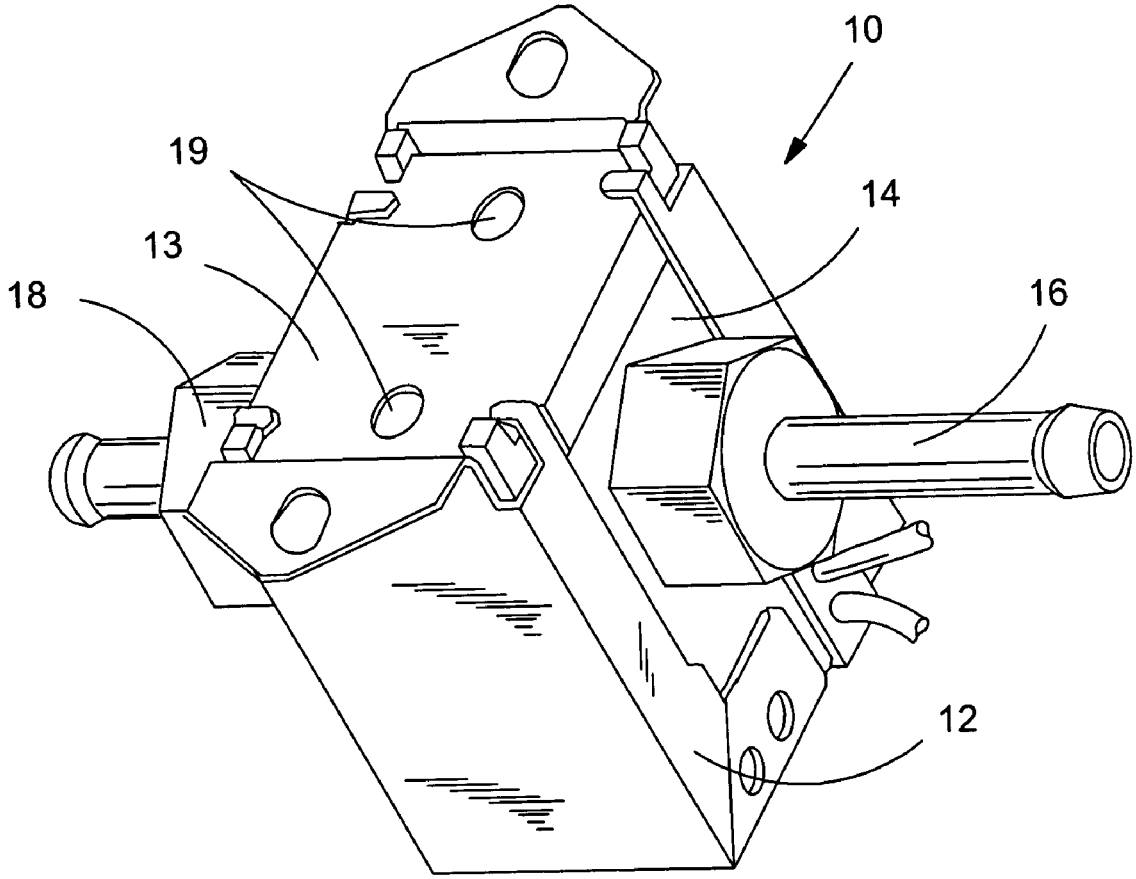
FIG. 1 is a perspective view of a known electromagnetic pump formed from a metal pump housing.

Adverting now to the Figures, FIG. 1 illustrates a prior art electromagnetic pump described in U.S. Pat. No. 4,306,842, which patent is incorporated herein by reference. Patented pump 10 includes a housing that comprises U-shaped yoke member 12, parallel leg 14, and connecting plate 13. A second parallel leg plate, arranged opposite leg 14, is not shown in the figure. Inlet fixture 18 and outlet fixture 16 (the inlet and outlet ports) are operatively arranged to permit fuel pumping from a fuel source, for example, the fuel tank of an automobile. In this patented pump, the inlet and outlet ports are not integral with the housing. Rather, they are separately manufactured and then assembled/secured to the housing, a time-consuming assembly step.

Figure 2A:
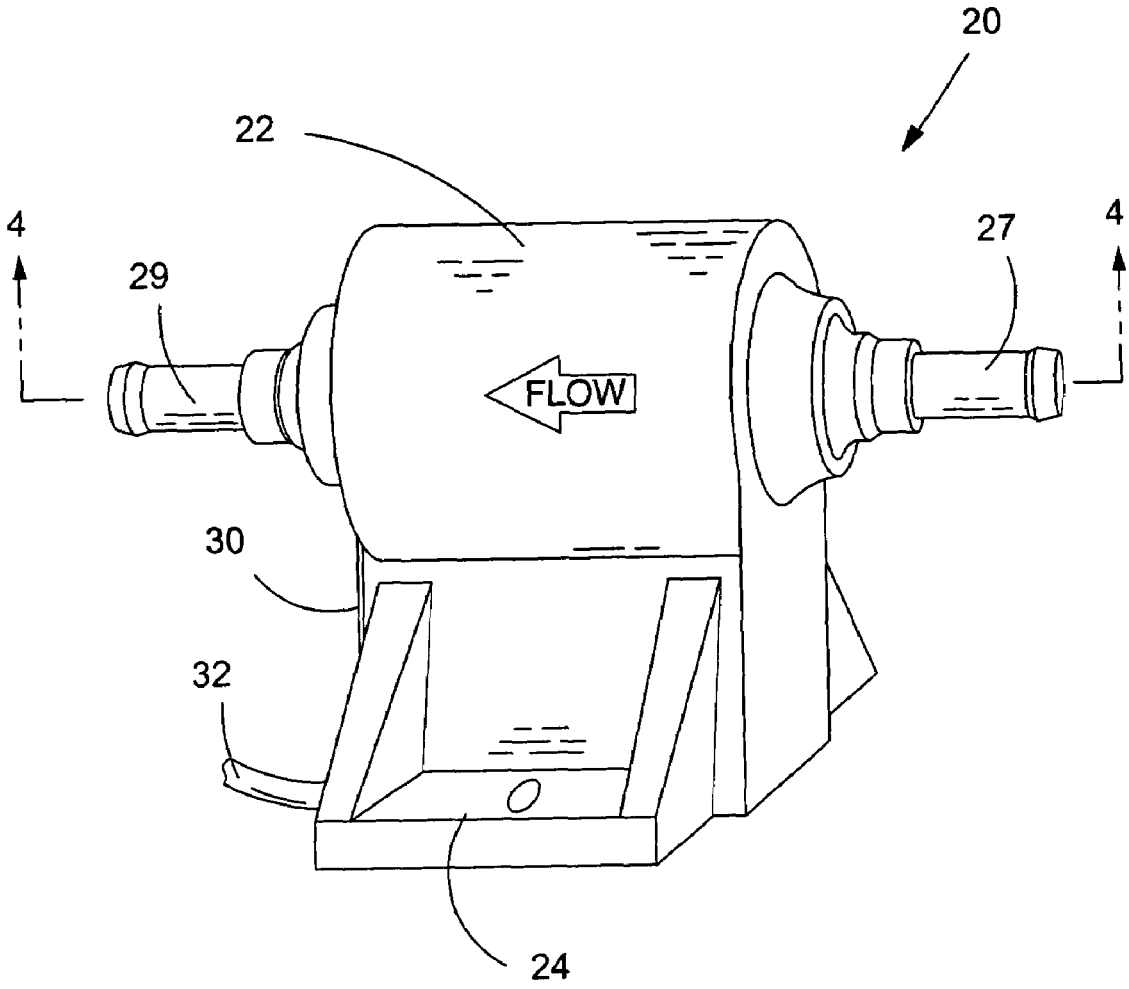
FIG. 2*a* is a perspective view of the present invention comprising integral ports.
Figure 2B:
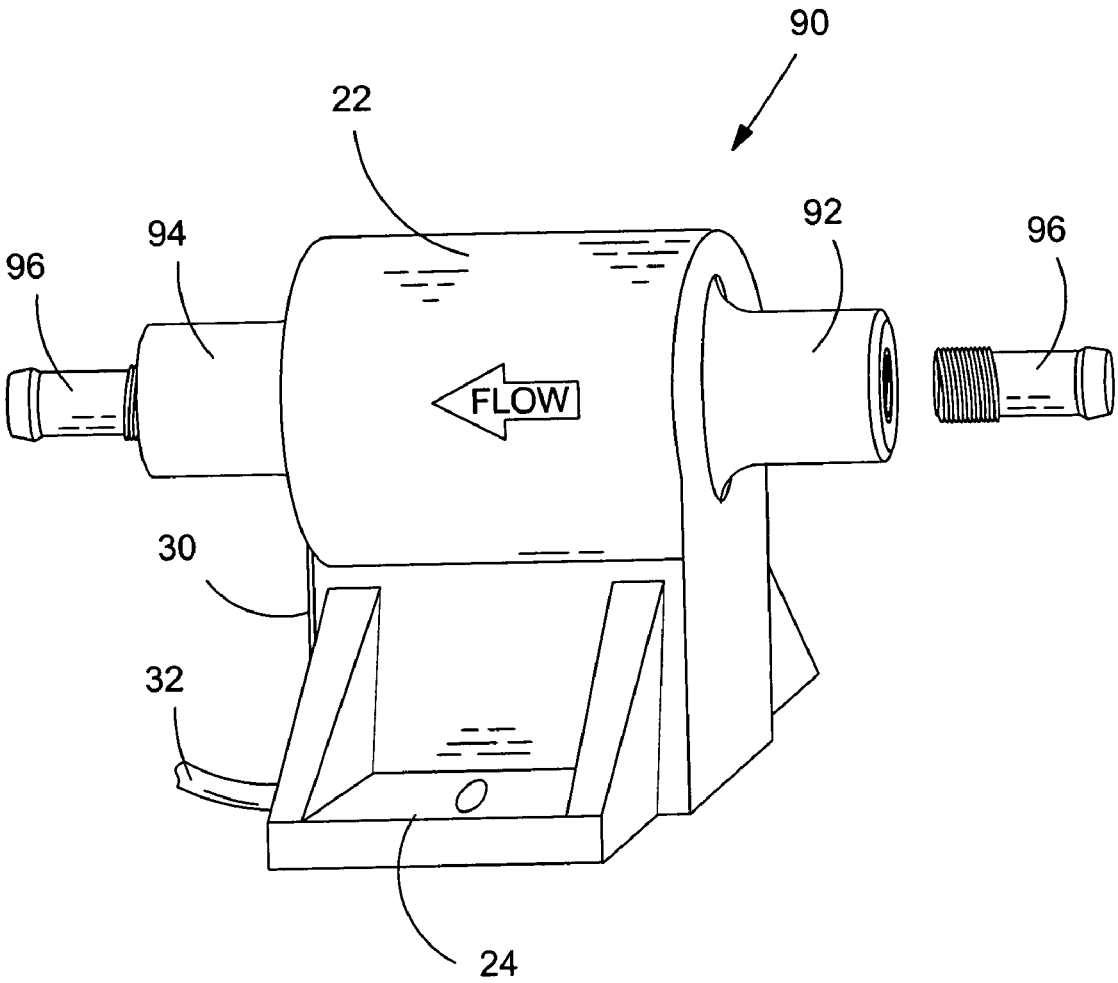
FIG. 2*b* is a view of the present invention comprising removable threaded ports.

Referring now to FIGS. 2*a* and 2*b*, outer structures of electromagnetic pump 20 according to the present invention are broadly illustrated as comprising housing 22, mounting flange 24, integral inlet mount 27, integral outlet mount 29, end cap 30 and power leads 32. Housing 22 generally comprises integral inlet mount 27 and integral mounting flange 24.

In a preferred embodiment housing 22 is constructed from molded plastic capable of withstanding the harsh environment of an engine compartment or chassis. Housing 22 is substantially cylindrical in shape such that a cavity is formed for accepting inner pump components. It should be appreciated, however, that the outer surface of the pump housing could comprise virtually any shape as may be desired and may be constructed from other moldable materials as may be appropriate. Integral inlet mount 27 is provided for connecting pump 20 to a fuel source via a fuel line (not shown) and further comprises inlet port 26 (See FIG. 4). Integral mounting flange 24 is provided for securing the fuel pump to the surface of a fuel tank or as may be desired. End cap 30 generally comprises integral outlet mount 29 and is structured for complementary fit to the end of housing 22 and is sealably secured thereto by appropriate means, for example, sonic welding, etc. Integral outlet mount 29 is provided for connecting an outlet fuel line (not shown) for delivery of fuel to a fuel distribution means such as a carburetor, fuel injector, or the like via outlet port 29. Power leads 32 provide the electrical energy required to operate the pumping mechanism and connects to printed circuit board 44 (See FIG. 3).

Alternatively, FIG. 2*b* illustrates pump 90 configured to comprise threaded inlet 92 and threaded outlet ports 94 adapted for threadably inserting and removing threaded nipples 96 from housing 22 as may be desired, as for instance, to change the size of the nipples. In some aspects, housing 22 is a two piece housing made of a first material. A first piece, body 22, of the two piece housing includes threaded insert inlet port 92 and a second piece, cap 30, of the two piece housing includes threaded insert outlet port 94. The insert inlet and outlet ports are made of a second material.

Figure 3:
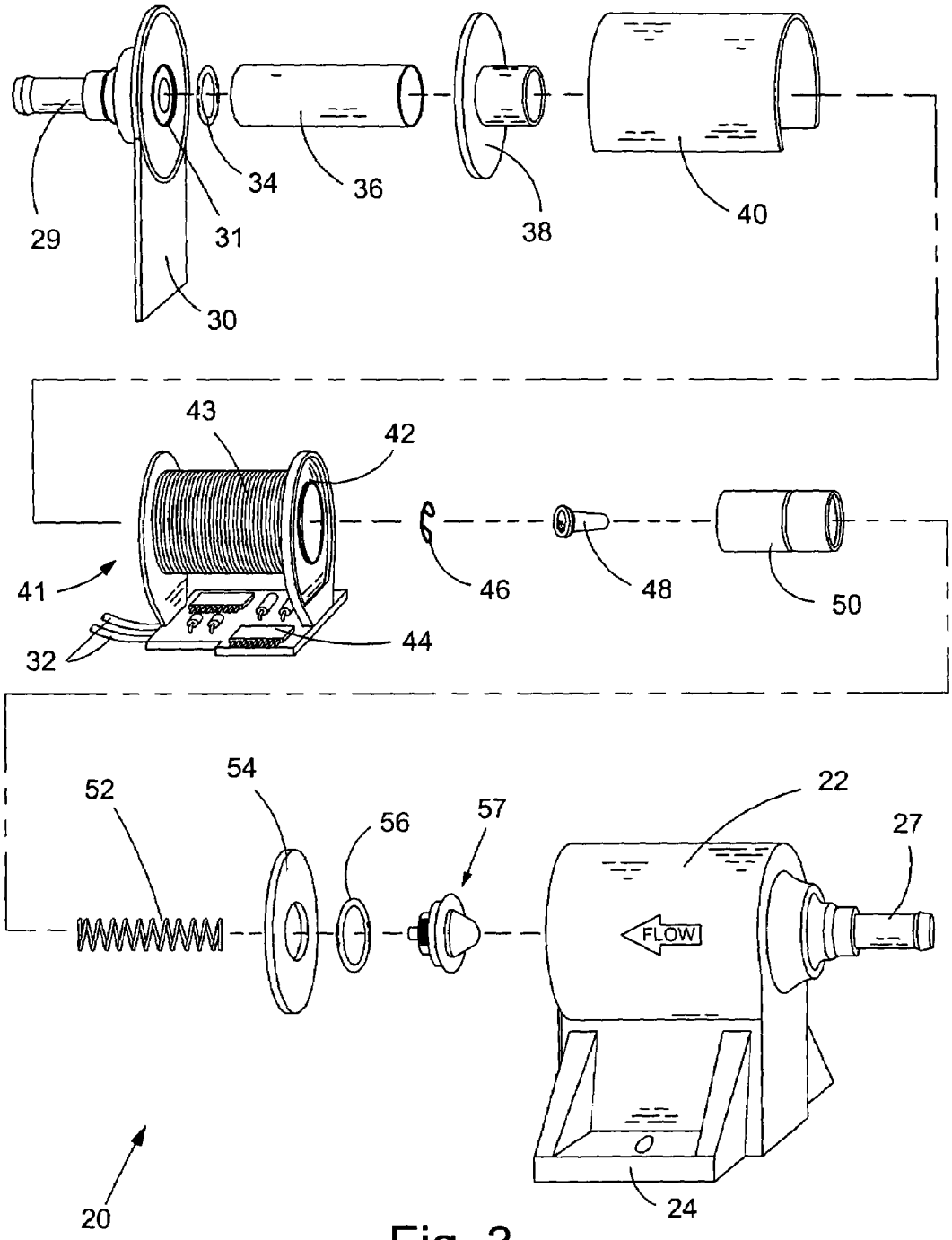
FIG. 3 is an exploded view of the pump shown in FIG. 2.
Figure 4:
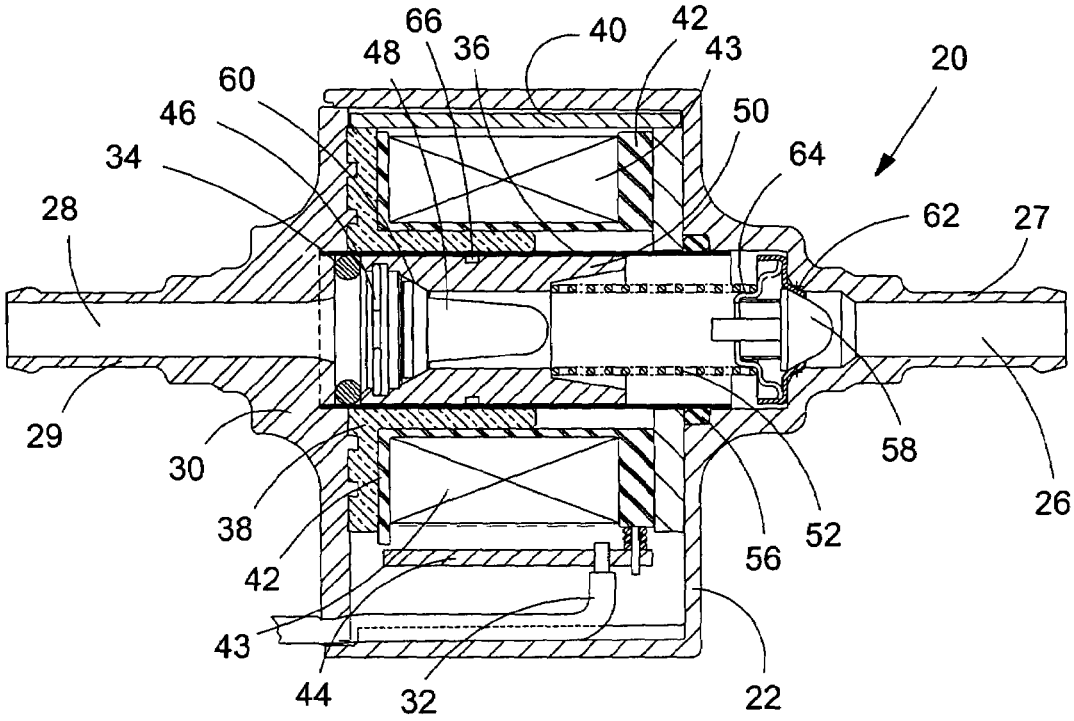
FIG. 4 is a cross sectional view of the electromagnetic fuel pump of the present invention, taken generally along line 4—4 of FIG. 2*a;*
Figure 5:
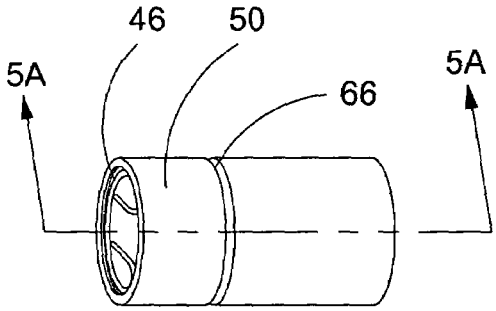
FIG. 5 is a perspective view of the discharge plunger assembly of the electromagnetic fuel pump of the present invention.
Figure 5A:
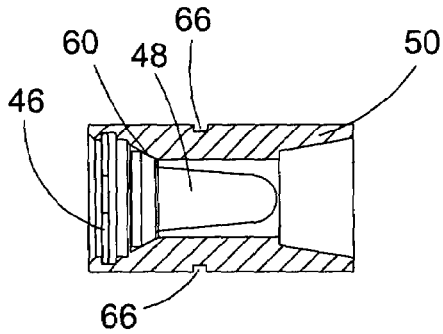
FIG. 5A is a cross-sectional view of the discharge plunger assembly of FIG. 5, taken generally along line 5A—5A of FIG. 5.
Figure 6:
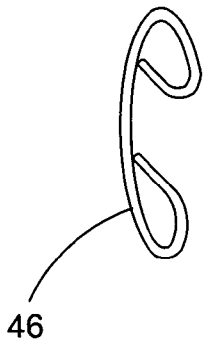
FIG. 6 is a perspective view of the clip for retaining the plunger valve within the discharge plunger assembly of FIG. 5.
Figure 7:
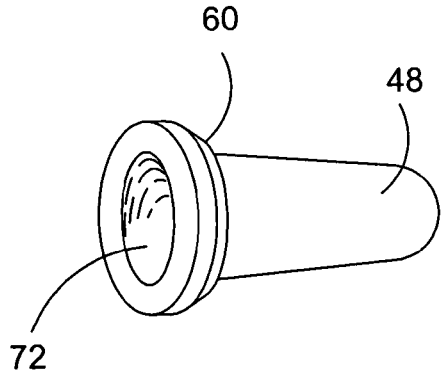
FIG. 7 is a perspective view of the plunger valve shown in FIG. 3.

Referring now to FIG. 3, as described supra, the inner structures of the pump of the present invention are operatively arranged to be secured within the cavity formed by housing 22 and end cap 30. The inner structures of the pump broadly comprise end cap O-ring 34, tube 36, first EM end cap 38, EM shield 40, bobbin 42, coil 43, printed circuit board 44, discharge valve retaining clip 46, discharge valve 48, discharge plunger 50, helical spring 52, second EM protective housing end cap 54, housing O-ring 56 and inlet valve assembly 57.

With reference now to FIGS. 3–9, it is seen that sleeve 36 is operatively arranged for passing fluid therethrough and longitudinally traverses the pump from inlet port 26 to outlet port 28. Tube 36 is adapted for slip fit into housing 22 and molded into the cover 30. O-rings 34 and 56 are disposed within the tube and about the outer surface of the tube for dampening impact forces and preventing leakage of fluid therefrom, respectively. Tube 36 serves as the primary location wherein mechanical pumping operations are performed. Discharge valve retaining clip 46 secures discharge valve 48 into plunger 50; plunger and spring 52 are adapted for reciprocating movement within tube 36. Valve 57 is retained in position between the force of spring 52 and housing 22. Tube 36 is made from a non-magnetic material and spring 52 may vary according to pump type and the pressure output of the pump.

Figure 8:
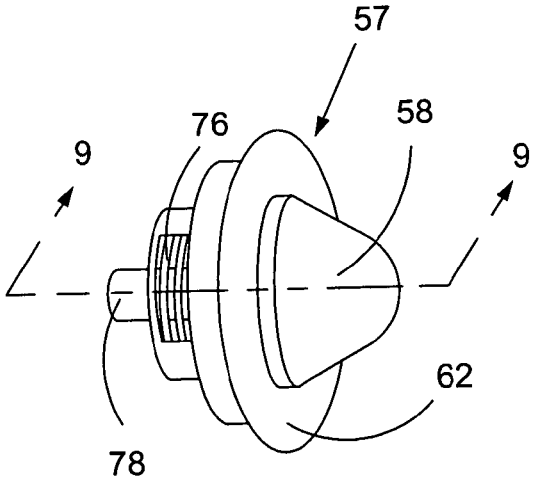
FIG. 8 is a perspective view of the inlet valve shown in FIG. 3.
Figure 9:
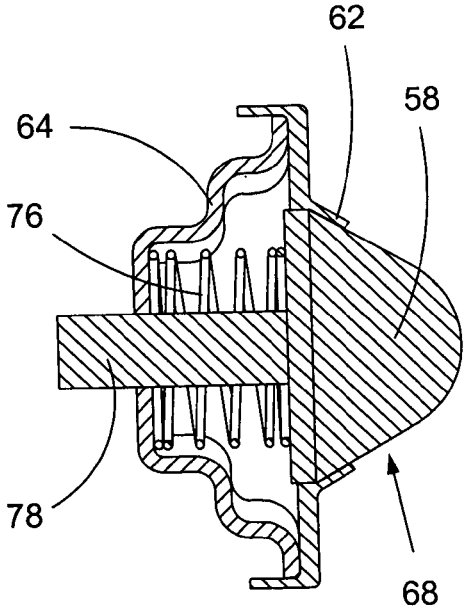
FIG. 9 is a cross-sectional view of the inlet valve, taken generally along line 9—9 of FIG. 8.

Disposed within plunger 50 is the plunger valve 48 and retaining clip 46. As illustrated more clearly in FIGS. 5–7, plunger valve 48 is operatively arranged for sealable fit within plunger 50 and comprises plunger valve sealing surface 60 for creating a seal between the plunger valve and the plunger. Plunger valve 48 is releasably retained within plunger 50 by means of plunger valve retaining spring clip 46. As shown more clearly in FIG. 7, plunger valve retaining spring clip 46 secures plunger valve 48 to plunger 50. Plunger valve 48 further comprises recess 72 capable of swelling for purposes of dampening pressure increases proximate the pump output as described in U.S. Pat. No. 3,797,522, which is incorporated herein by reference As shown in FIGS. 8 and 9, suction valve assembly 57 generally comprises a one-way check valve for drawing fuel from a fuel source such as a fuel tank as described infra. Suction valve assembly 57 includes inlet valve 58, inlet valve sealing surface 62, inlet valve housing 64, inlet valve spring 76 and inlet valve location post 78.

Operatively arranged about the outside of tube 36 is first EM cap 38, shield 40, bobbin 42, coil 43, second EM cap 54, and circuit board 44. Circuit board 44, in combination with coil 43 and power leads 32 form drive circuit 80 (See FIG.

10). Coil 43 comprises a single strand of wire wound about bobbin 42. Coil 43 is operatively arranged to create an electromagnetic force when energized to attract plunger 50 against the force of spring 52 to its center of magnetic mass. First and second EM caps 38 and 54, respectively, along with shield 40 are formed from metal and comprise an enclosure for providing a closed EM loop circuit. The metal enclosure is positioned between housing 22 and end cap 30, and electrical circuit 80 (See FIG. 10). By encapsulating the electrical components within a metal shield, the emission of EMI is prevented. In a preferred embodiment the metal enclosure is fabricated from sheet metal. In some aspects, metal shield 40 is a metallic conformal coating within housing 22.

Figure 10:
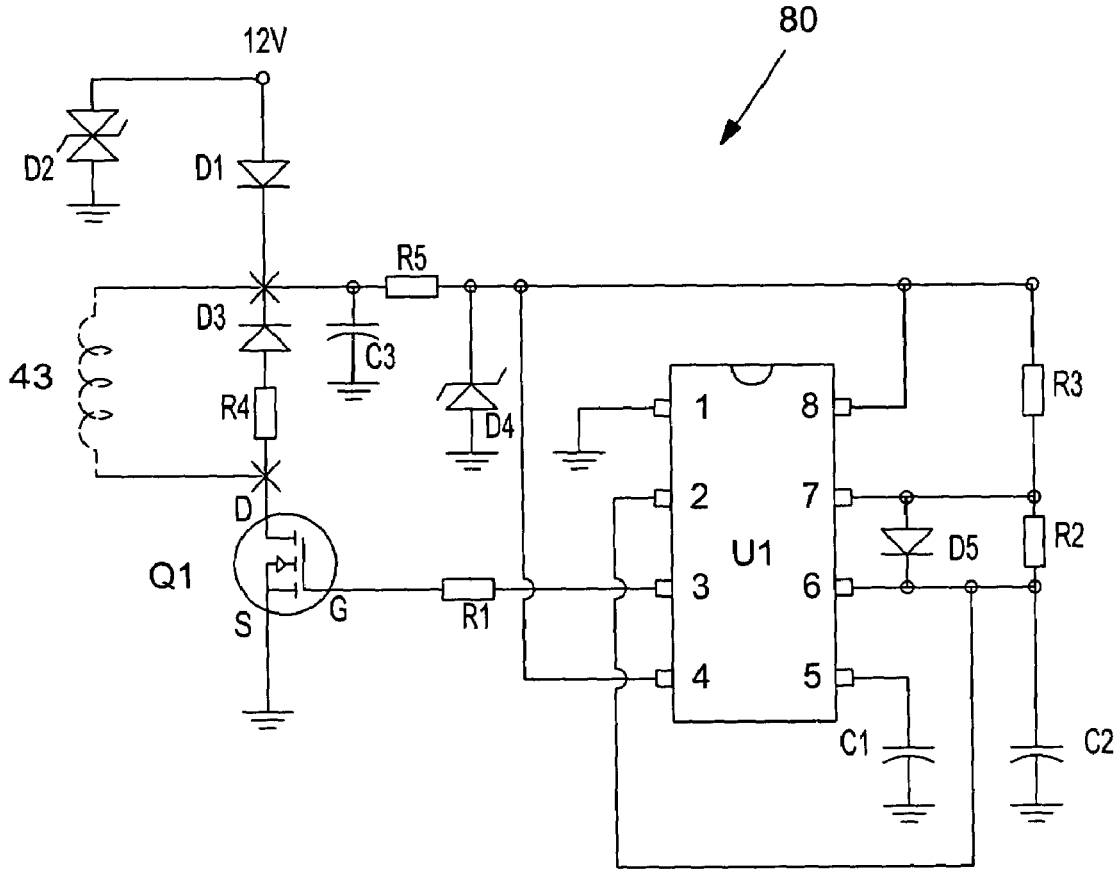
FIG. 10 is a schematic diagram of the timing and switching circuit for the coil of the electromagnetic fuel pump; and, FIGS. 11A–11C depict rest, filling, and dispensing stages, respectively, of the electromagnetic fuel pump of the present invention.

FIG. 10 illustrates drive circuit 80 for the electromagnetic pump of the invention. In a preferred embodiment, the components of drive circuit 80 are surface mounted on printed circuit board 44, which is mounted on the coil via conductive-pinned bobbin assembly within housing 22. Circuit 80 includes electronic switching circuitry for controlling electromagnetic coil 43. The circuit broadly comprises U1, a 555 timer or equivalent, operatively arranged to MOSFET SMT switch Q1 which comprises a 15A, 60V, N-Channel, (55 deg C/+175 Deg C) DPAK. In a preferred embodiment, R2 and R3 are selected, as is well known in the art, such that the timer controls Q1 to a 70 ms period with "On" time of approximately 25 ms, and an "Off" time of approximately 45 ms. When MOSFET Q1 is turned "On" (25 ms), coil 43 is energized and attracts the plunger against spring 52. When MOSFET Q1 is turned "Off" (45 ms) coil 43 discharges through R4/D3 and spring 52 returns plunger 50 to its point of origin. In a preferred embodiment, coil 43 is made of 21 gauge magnet wire and is a 2 mH inductor with a resistance of 1.4 ohms. Circuit 80 also includes surge suppression Zener diode D2 which protects the circuit against voltage overloads. Diode D1 functions as a polarity restrictor; D2 as overload protection; and D3 and R4 functions to direct and suppress the discharge current of the coil.

Figure 11A:
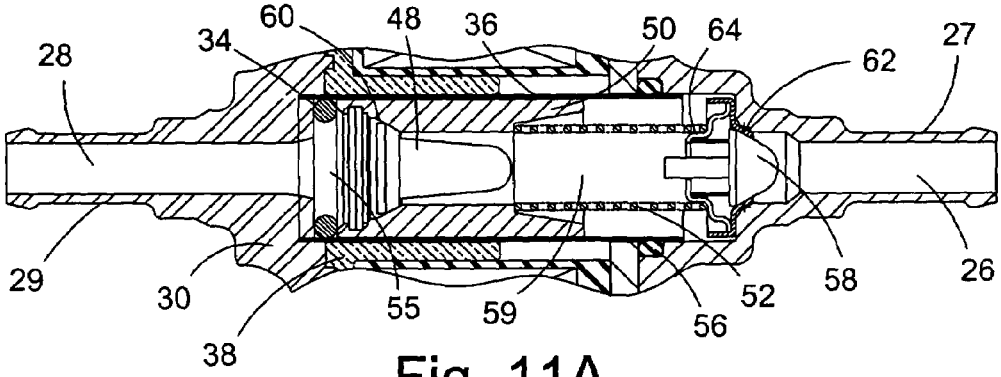
Figure 11B:
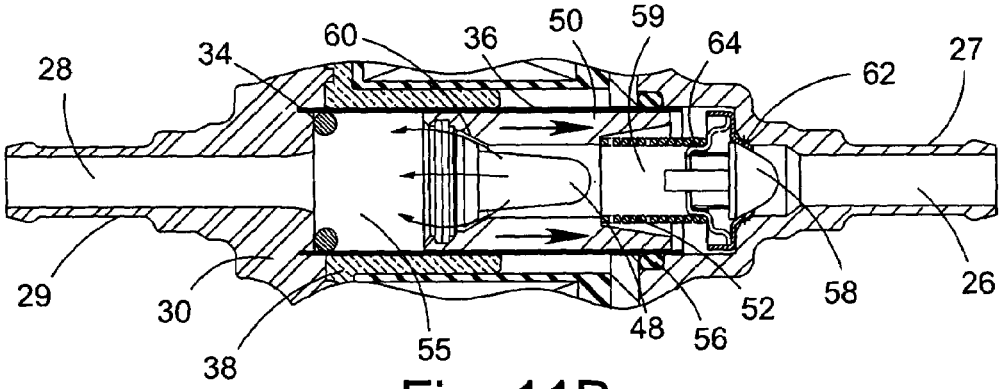
Figure 11C:
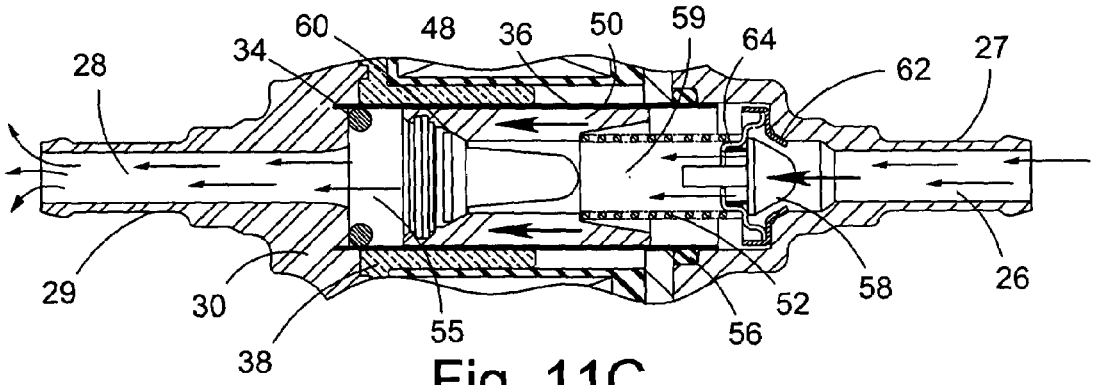

FIGS. 11A–11C depict the operational aspects of the electromagnetic fuel pump of the present invention. FIG. 11A shows plunger 50, plunger valve 48, inlet valve 58, and spring 52 in their rest positions. While coil 43 is not energized, spring 52 biases plunger 50 against O-ring 34. If backpressure exists, i.e., pressure caused by fluid entering from outlet port 28, plunger valve 48 forms a seal at surface 60 with plunger 50 to prevent fluid from flowing past plunger valve 48 into first chamber 59. Inlet valve 58 is biased against plunger valve housing seal 62 by spring 76 (See FIG. 9). This seal prevents fluid flowing from first chamber 59, through plunger valve 58, and continuing out inlet port 26.

FIG. 11B illustrates coil 43 as being energized, which forms a magnetic field. The magnetic field created by the energized coil imparts a directional force upon plunger 50. This force causes plunger 50 to move rightwardly toward inlet port 26, thereby causing spring 52 to compress. As a result of the rightward movement and the configuration of valve 48, fluid present in first chamber 59, just prior to energizing coil 43, is displaced around valve 48 and into second chamber 55. During this stage, fluid is prevented from moving between first chamber 59 and inlet port 26 by the seal created between inlet valve 58 and inlet valve housing seal 62.

Referring now to FIG. 11C, as coil 43 is de-energized, the magnetic field collapses. As a result, plunger 50 is no longer acted upon by a magnetic force and is returned to its rest location by the bias of spring 52. Two simultaneous events occur during the movement of plunger 50. First, fluid contained in second chamber 55 is forced out of outlet port 28. The fluid is prevented from entering first chamber 59 by the seal created between surface 60 of discharge valve 48 and plunger 50. Simultaneously, fluid is replenished in first chamber 59. As plunger 50 moves, a negative pressure, or suction, is created in first chamber 59. The negative pressure causes suction valve 58 to be displaced leftwardly to an open position, thus allowing fluid to be drawn from inlet port 26 into first chamber 59. O-ring 34 provides force dampening for the impact between plunger 50 and end cap 30 as plunger 50 returns to its rest location.

The operation described in the previous paragraphs, related to FIGS. 11A–11C, is cyclically repeated during the use of the pump. As mentioned previously, the timing circuit controls Q1 to switch "On" for approximately 25 ms, and switch "Off" for approximately 45 ms. This means that during each cycle of operation, the plunger is biased rightwardly by electromagnetic force for approximately 25 ms, and then biased leftwardly by the spring for approximately 45 ms. The reciprocal motion causes fluid to flow in inlet port 26, through inlet valve 58, first chamber 59, second chamber 55, and plunger valve 48, and out outlet port 28, thereby creating a continuous, low pressure flow of fluid.

Thus, it is seen that the objects of the present invention are efficiently obtained, although modifications and changes to the invention should be readily apparent to those having ordinary skill in the art, which modifications are intended to be within the spirit and scope of the invention as claimed.

What is claimed:

1. An electromagnetic fuel pump, comprising:

a pump;

electronic switching circuitry for controlling an electromagnetic coil operatively arranged to operate said pump;

a housing arranged to house said pump and said coil, said housing comprising an integral inlet port and a structural electromagnetic (EM) hardening means; and, an end cap with an integral outlet port.

2. The electromagnetic fuel pump recited in claim 1 further comprising a drive circuit housed within said housing, said drive circuit operatively arranged to drive said coil.

3. The electromagnetic fuel pump recited in claim 2, wherein said drive circuit further comprises a Zener diode operatively arranged as a surge suppressor.

4. The electromagnetic fuel pump recited in claim 1, wherein said housing further comprises at least one mounting flange.

5. The electromagnetic fuel pump recited in claim 1, wherein said housing further comprises a molded body.

6. The electromagnetic fuel pump recited in claim 1, wherein said inlet port further comprises an integral nipple, operatively arranged for coupling with an inlet fuel hose.

7. The electromagnetic fuel pump recited in claim 1, wherein said inlet port further comprises a threaded insert.

8. The electromagnetic fuel pump recited in claim 1, wherein said inlet port further comprises a bore; wherein said bore is operatively arranged for adhesion to an inlet fuel hose coupling nipple.

9. The electromagnetic fuel pump recited in claim 1, wherein said outlet port further comprises an integral nipple, operatively arranged for coupling with an outlet fuel hose.

10. The electromagnetic fuel pump recited in claim 1, wherein said outlet port further comprises a threaded insert.

11. The electromagnetic fuel pump recited in claim 1, wherein said outlet port further comprises a bore; wherein said bore is operatively arranged for adhesion to an outlet fuel hose coupling nipple.

12. The electromagnetic fuel pump recited in claim 1 wherein said structural EM hardening means comprises a metal shield within said housing.

13. The electromagnetic fuel pump recited in claim 12 wherein said metal shield comprises a metal screen within said housing.

14. The electromagnetic fuel pump recited in claim 12 wherein said metal shield comprises a metallic conformal coating within said housing.

15. The electromagnetic fuel pump recited in claim 1 further comprising a printed circuit board within said housing and a bobbin assembly fixedly secured to said printed circuit board, and wherein said electronic switching circuitry is mounted on said circuit board and said electromagnetic coil is mounted on said bobbin assembly.

16. The electromagnetic fuel pump recited in claim 15 wherein said bobbin assembly comprises a pair of opposing flanges, and one of said flanges is fixedly secured to said printed circuit board.

17. The electromagnetic fuel pump recited in claim 16 wherein one of said flanges is fixedly secured to said printed circuit board and the other said flange is arranged to rest upon said printed circuit board.

18. An electromagnetic fuel pump, comprising:

a pump;

electronic switching circuitry for controlling an electromagnetic coil operatively arranged to operate said pump; and, a two piece housing operatively arranged to house said pump and said coil, said two piece housing is comprising a first material and a structural electromagnetic (EM) hardening means, wherein a first piece of said two piece housing comprises a threaded insert inlet port and a second piece of said two piece housing comprises a threaded insert outlet port; said threaded insert inlet and outlet ports comprising a second material and wherein said inlet port and said outlet port are adapted for threadably inserting and removing threaded nipples.

19. An electromagnetic fuel pump, comprising:

a pump;

electronic switching circuitry for controlling an electromagnetic coil operatively arranged to operate said pump;

a housing arranged to house said pump and said coil, said housing comprising an integral inlet port, wherein said inlet port and said housing are formed from a first single piece, said inlet port comprises a first integral nipple, and said inlet port is operatively arranged for coupling with a first fuel hose; and, an end cap with an integral outlet port, wherein said outlet port and said end cap are formed from a second single piece, said outlet port comprises a second integral nipple, and said outlet port is operatively arranged for coupling with a second fuel hose, wherein said housing and said end cap are made from molded plastic.

* * * * *